US005832676A

United States Patent [19]

Gillmore et al.

[11] Patent Number: 5,832,676

[45] Date of Patent: Nov. 10, 1998

[54] DISASTER RESTORAL POP-UP STRUCTURE

[75] Inventors: William E. Gillmore, Richardson; Freddie Hugh Sebren, Wylie, both of Tex.

[73] Assignee: MCI Communications Corporation, Washington, D.C.

[21] Appl. No.: 742,219

[22] Filed: Oct. 31, 1996

[51] Int. Cl.[6] ..... E04B 1/99

[52] U.S. Cl. ..... 52/67; 52/79.1; 52/115; 248/69; 248/654

[58] Field of Search ..... 52/36.2, 66, 670, 52/71, 79.1, 115; 248/669, 654

[56] References Cited

U.S. PATENT DOCUMENTS

| | | | |
|---|---|---|---|
| 3,546,827 | 12/1970 | Demarais | 52/36.2 X |
| 3,832,810 | 9/1974 | Johnston | 52/67 |
| 3,958,376 | 5/1976 | Campbell | 52/15 |
| 4,112,634 | 9/1978 | Bissinger | 52/67 |
| 4,358,915 | 11/1982 | Pantalone | 52/115 |
| 4,536,996 | 8/1985 | Soden et al. | 52/67 |
| 5,475,949 | 12/1995 | McCoy | 52/67 |
| 5,572,837 | 11/1996 | Featherstone et al. | 52/115 X |

*Primary Examiner*—Christopher Kent
*Assistant Examiner*—Yvonne Horton-Richardson

[57] ABSTRACT

A structure having dimensions for transportation on an airplane, and which when assembled into a module has sufficient headroom for an average height person. The structure includes two portions, a top portion and a bottom portion. The top portion fits over and envelopes the bottom portion prior to assembly. The pre-assembly structure is thus easily transportable. To form the module, the top portion is raised to a higher level using pneumatic compressors. Folding walls are also provided in the structure, which when unfolded form the walls for the module. The folding walls may further include doors also provided in a folded form. The pre-assembled structure is designed for ease of construction to form the corresponding module. Several such modules may be combined to form a building.

19 Claims, 17 Drawing Sheets

Folding Up, First Phase

Installed

Stowed Position

Second Phase

Stowed Position

Folding Up, First Phase

Second Phase

Installed

DISASTER RESTORAL POP-UP STRUCTURE

BACKGROUND OF THE INVENTION

1. Field of the Invention

The present invention relates generally to the field of disaster recovery, and more particularly to a portable structure which may be easily erected to form a room (e.g., for use as an office) of desired configuration.

2. Related Art

Disasters such as earthquakes and floods may inflict great havoc on an area. As a result, buildings may be demolished and transportation facilities (such as airports/roads/bridges) may be destroyed. People in the area may have neither a roof to take shelter under nor the mobility to move to another area which is unaffected by the disaster. In addition, telecommunications services such as telephone calls may also be totally disrupted leading to further aggravation of the situation.

A telecommunication company may wish to provide telecommunication services to people in such a disaster area. An example of such a service is "Call Home MCI$^{SM}$," provided by MCI Communications Corporation to the disaster survivors to contact family/friends.

However, provision of such a service may encounter several impediments. For example, the disaster stricken area may not have suitable buildings/structures to set up equipment (e.g., telephones, switches, computers) for providing the service. A service provider may consider moving a pre-assembled structure using ground-transportation. However, ground transportation may not be possible due to the destruction of transportation facilities such as roads and bridges to the area.

As an alternative, a service provider may consider transporting a suitable structure by air. However, typical airline carriers have limitations in terms of size and weight for any freight item carried. For example, a Boeing-737 airplane can only carry cargo items having dimensions less than 64"×88"×125".

Prefabricated structures within such size limits may be unsuitable for setting up telecommunications equipment due to, for example, the relatively low height of the structure. On the other hand, installing a suitable room without such prefabrication may require an inordinate amount of time and human resources, which may not be readily available. Thus, such a scheme requiring extensive resources for installation may be unacceptable.

Therefore, what is needed is an easily transportable structure which can easily be converted into a room for use as an office.

SUMMARY OF THE INVENTION

The present invention is directed to a structure which has suitable dimensions to be transported using an airplane and which can then be easily assembled to form a module having sufficient height to provide adequate headroom for an average height person. The structure comprises a top portion and a bottom portion. The top portion fits over the bottom portion in a first position. In the first position, the structure is compact enough for transportation using a typical airplane. In a second position, the top portion is raised relative to the bottom portion. Such a raising provides a desired height to the resulting module. The present invention provides a set of pneumatic cylinders to aid in the raising of the top portion.

The bottom portion has openings for providing folding walls and walkways. The walls are folded in the first position, enabling the structure to take a compact form. The walls may further have a folding door. The door jamb has a channel defined between the edges of the wall. The channel holds the portions of the folding doors when the structure is being transported.

A walkway is designed to have width approximately equal to the space between the top portion and the bottom portion in the second (i.e., erected) position. Panels may be provided in the opening of the bottom portion which can be removed to form the walkway. The removed panels may be used as walls around the walkway.

Thus, a structure in accordance with the present invention is compact in a first position, enabling transportation using an airplane.

The fully assembled structure (in the second position) provides sufficient headroom for an average height person such that the resulting module may be used as, for example, an office.

By providing folding walls and folding doors, the present invention enables the structure to be compact during transportation.

The assembly of the structure is simplified due to features of the present invention. Such features include using folding doors, providing pneumatic cylinders etc.

Further features and advantages of the invention, as well as the structure and operation of various embodiments of the invention, are described in detail below with reference to the accompanying drawings. In the drawings, like reference numbers generally indicate identical, functionally similar, and/or structurally similar elements. The drawing in which an element first appears is indicated by the leftmost digit(s) in the corresponding reference number.

BRIEF DESCRIPTION OF THE FIGURES

The present invention will be described with reference to the accompanying drawings, wherein.

DETAILED DESCRIPTION OF THE PREFERRED EMBODIMENTS

The present invention is directed to a set of structures which may be flown by an airplane to a disaster stricken site and easily assembled there. Each flown structure is within pre-specified dimensions and weight such that the structure may be flown by a common carrier such as Boeing-737 or Boeing-767 airplanes. When fully assembled, the resulting modules are of sufficient height to allow adequate headroom for an average adult. In addition, the flown structure is designed for ease of installation, making it particularly suited for installation at a disaster area.

Figure 1:
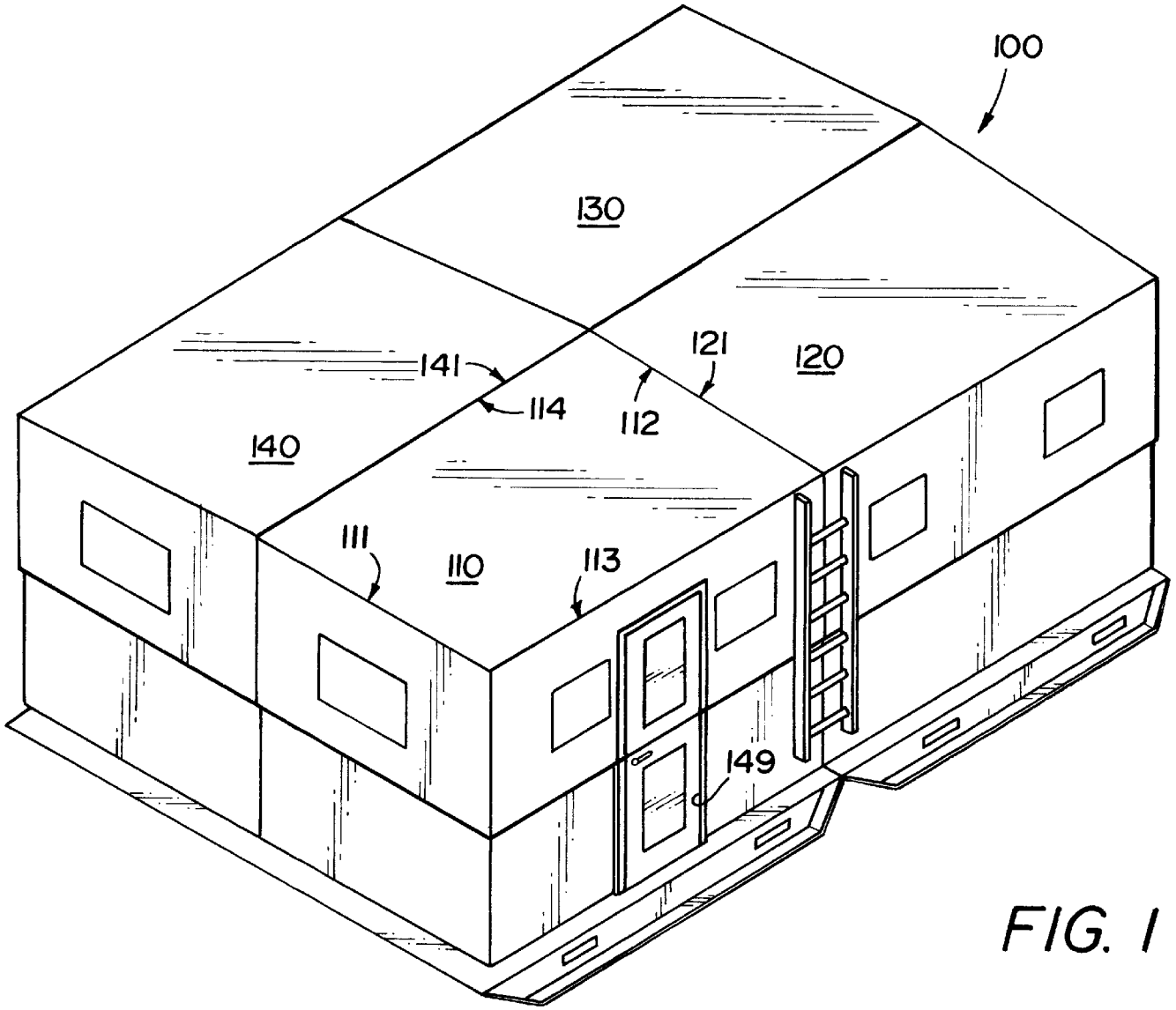
FIG. 1 is a diagram illustrating a structure of a building after the erection of four modules provided in accordance with the present invention.

FIG. 1 is a diagram illustrating an example building 100 which is formed by four assembled modules 110, 120, 130, and 140. For purposes of brevity and clarity, the present invention will be explained mostly with reference to assembled module 110. However, it will be apparent to one skilled in the relevant art to make and use the other modules based on the description provided herein with reference to module 110. In one embodiment, it is contemplated that the assembled module 120 will be used for installation of power and air-conditioning equipment for building 100. Remaining modules 110, 130, and 140 are contemplated to be used for office space, conference rooms, and customer service booths.

The manner in which module 110 is formed in accordance with the present invention is now explained. First, the formation of module 110 is explained with reference to the flow-chart of FIG. 3. The structural details of each component of module 110 are then explained with reference to FIGS. 2A–F, and 4–13.

Figure 2A:
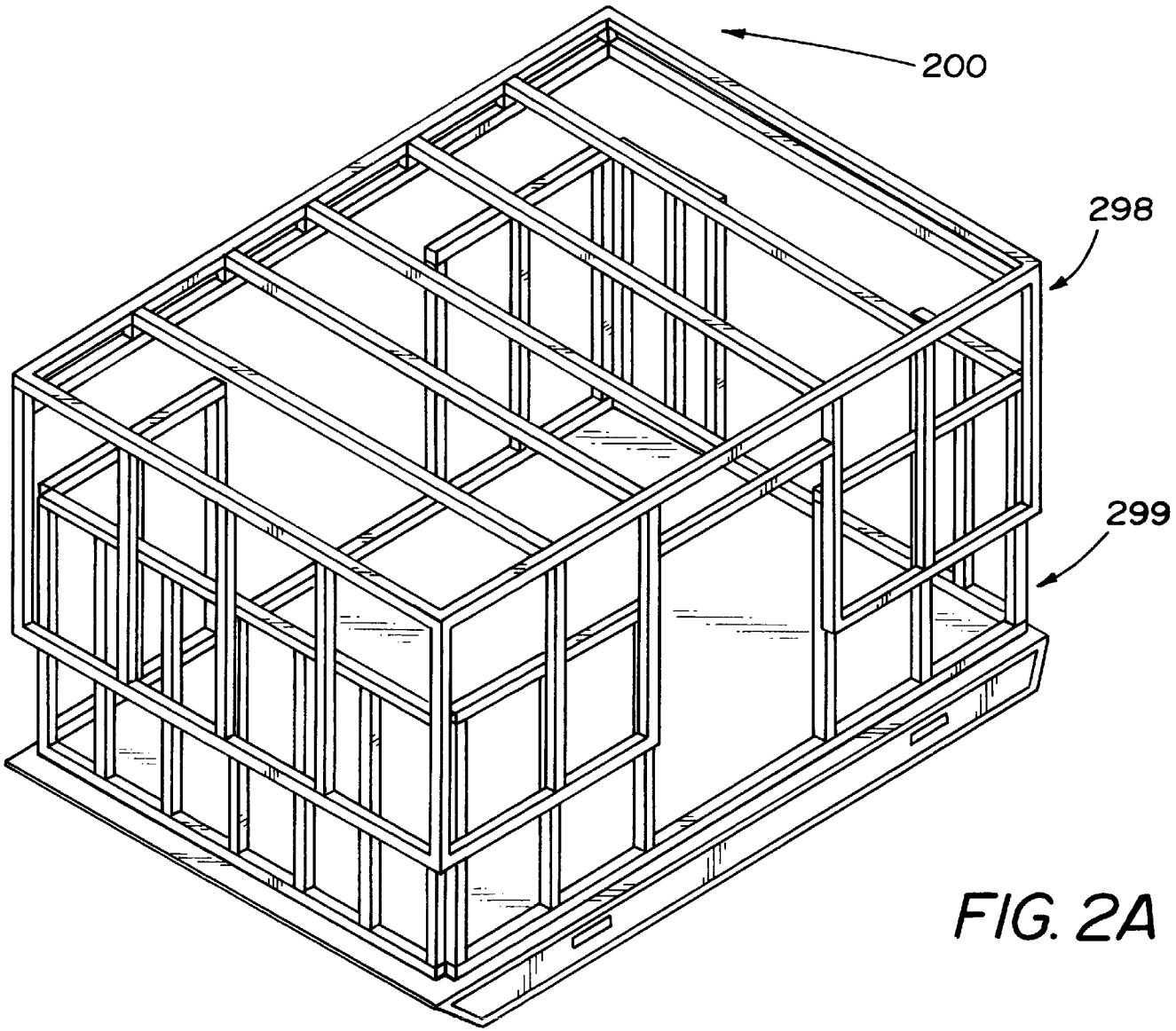
FIG. 2A is a diagram illustrating an example structure which when completely assembled forms a module of FIG. 1.
Figure 3:
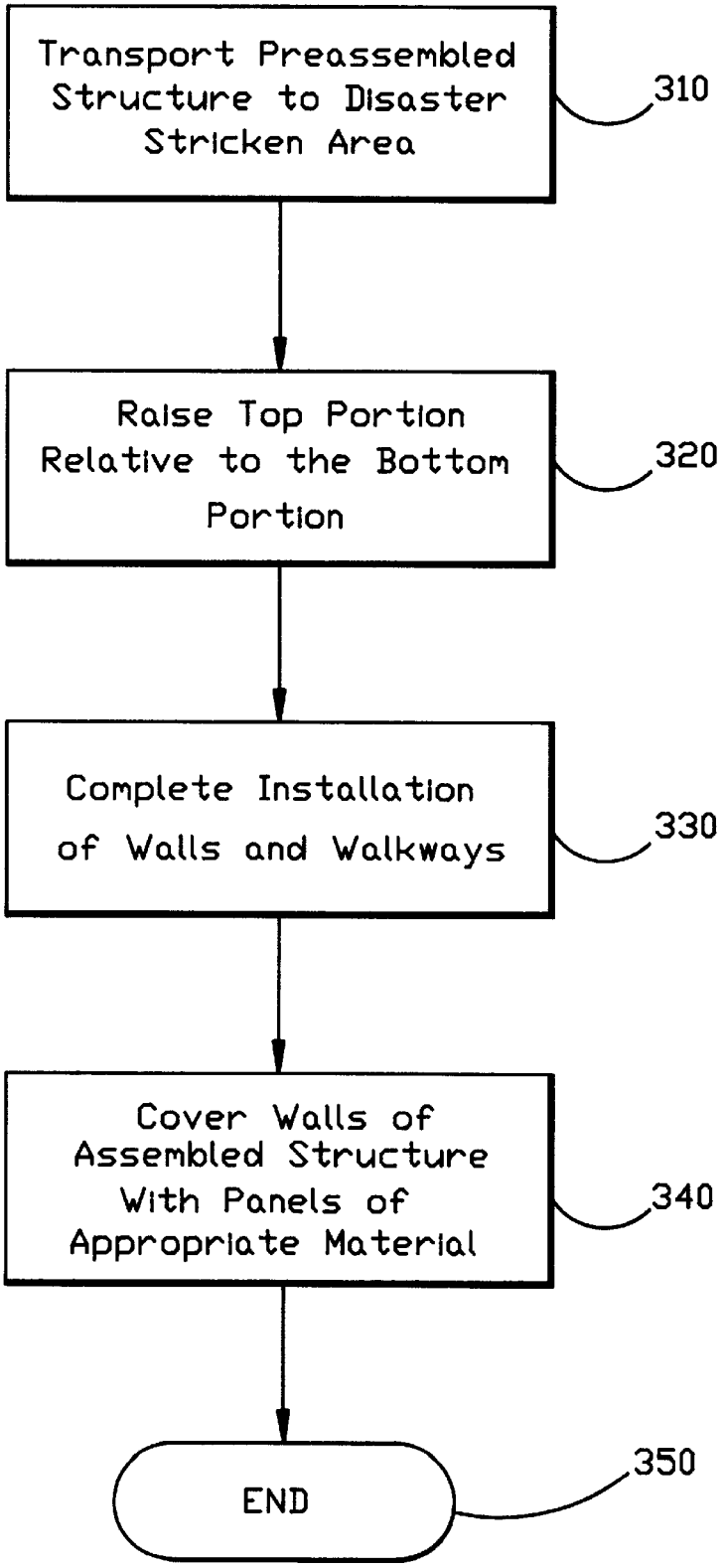
FIG. 3 is a flow-chart illustrating the steps performed in forming the module of FIG. 1 from the example structure of FIG. 2A.

FIG. 3 is a flow-chart illustrating the steps performed to assemble structure 200 shown in FIG. 2A to form module 110 of FIG. 1. Before assembly, structure 200 is transported (typically flown using an airplane) to a disaster stricken site in step 310. As will be explained later, structure 200 is compact before assembly as top portion 298 fits over bottom portion 299, and as the walls and doors are folded.

The assembly of structure 200 begins in step 320, in which top portion 298 is raised relative to bottom portion 299 so as to provide sufficient headroom for an average height person in the assembled structure (discussed with reference to FIGS. 2A–F). In step 330, folding walls and folding doors are unfolded (discussed with reference to FIGS. 4A–G, 5A–D, 6A–D, 7, 8A and 8B) in the openings provided between top portion 298 and bottom portion 299. In step 340, the walls of the assembled structure are covered with appropriate panels to shield against air, heat, sound etc., and to provide windows as desired.

Figure 2B:
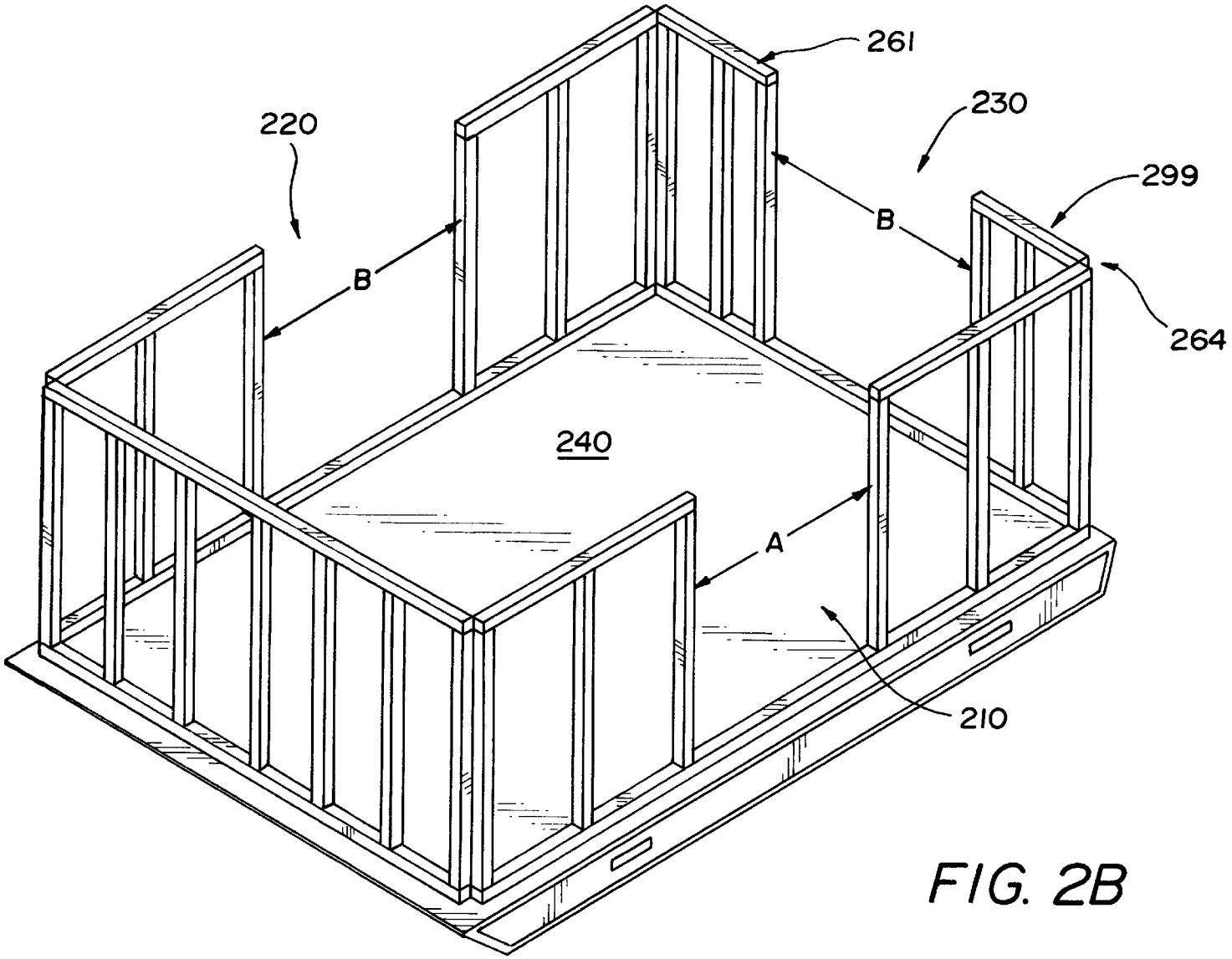
FIG. 2B is a diagram illustrating the details of bottom portion of the structure of FIG. 2A.
Figures 2C, 2D:
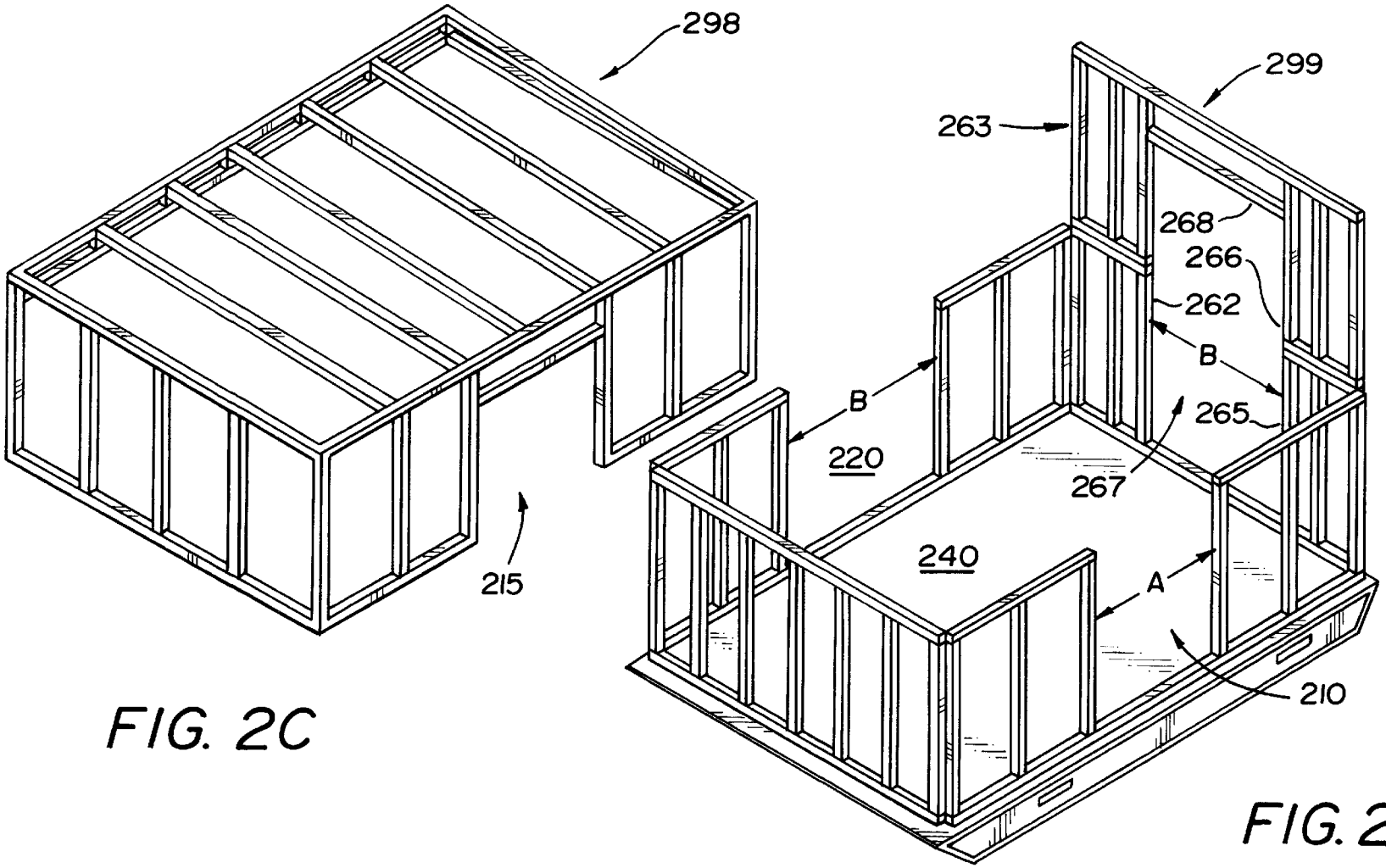
FIG. 2C is a diagram illustrating the details of top portion of the structure of FIG. 2A.
FIG. 2D is a diagram illustrating the folded walls in the bottom portion.
Figure 2E:
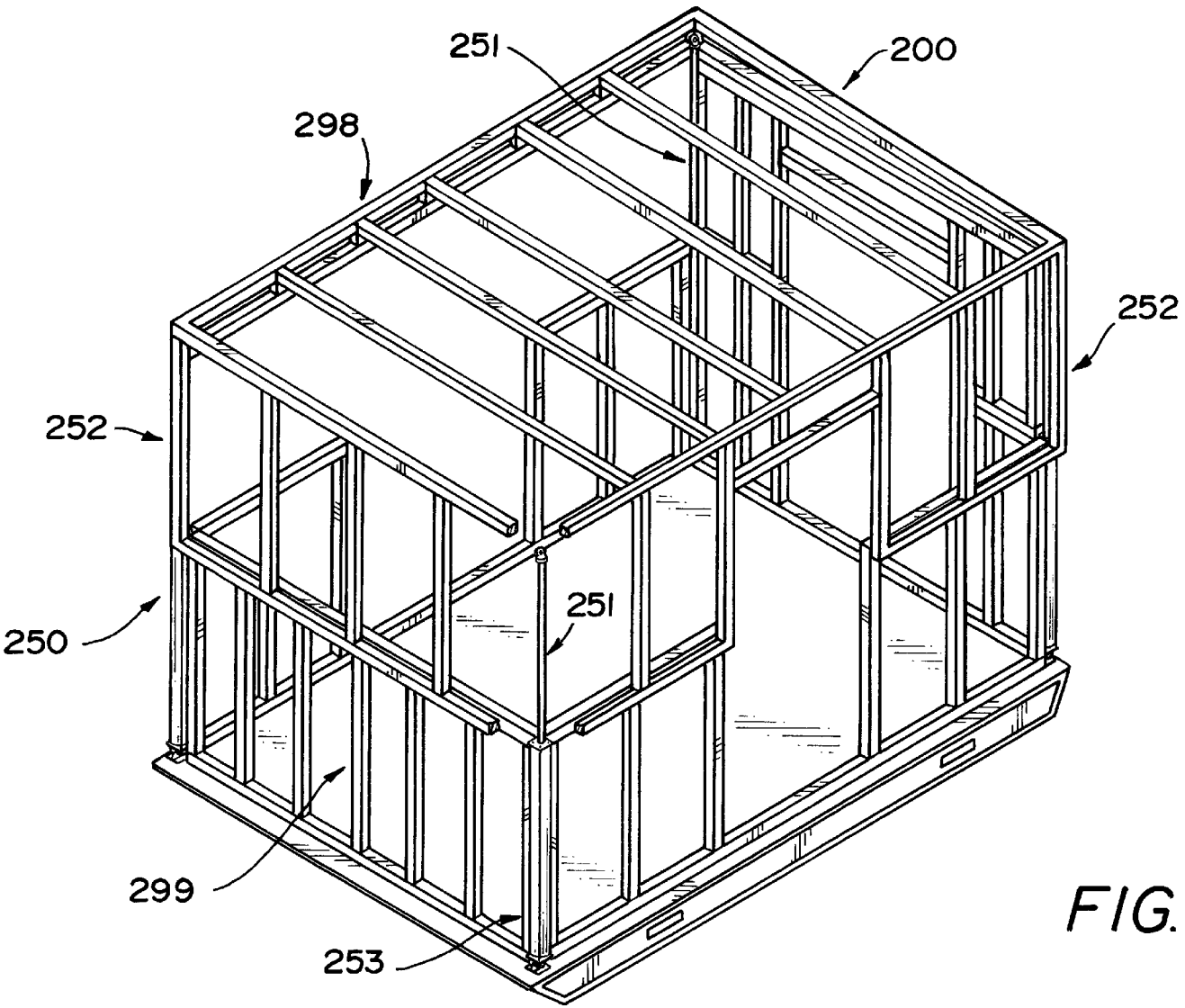
FIG. 2E is a diagram illustrating the structure of FIG. 2A after it is raised to a desired level.
Figure 2F:
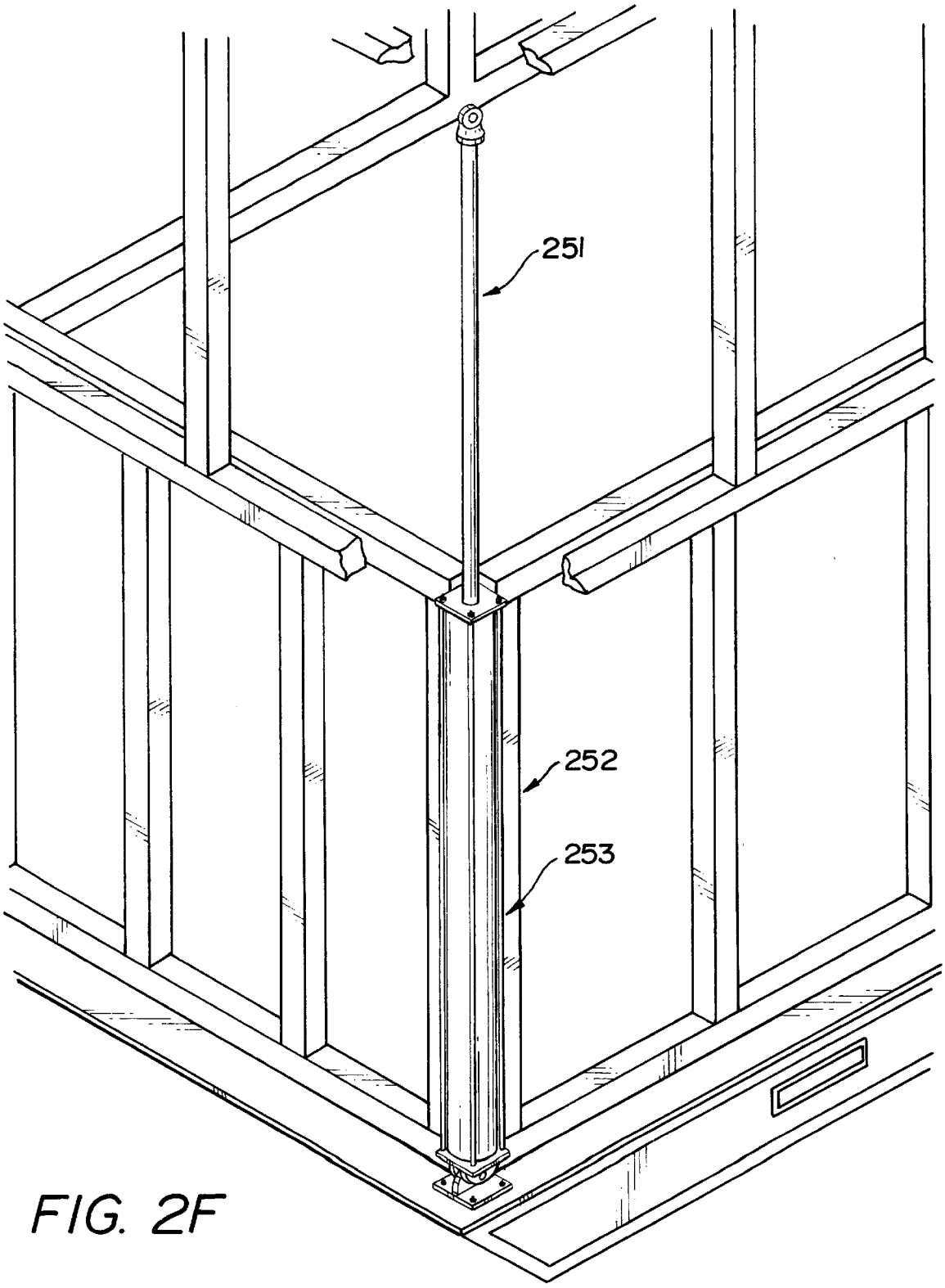
FIG. 2F is a diagram with a detailed view of a pneumatic cylinder used for raising the top portion.
Figure 2G:
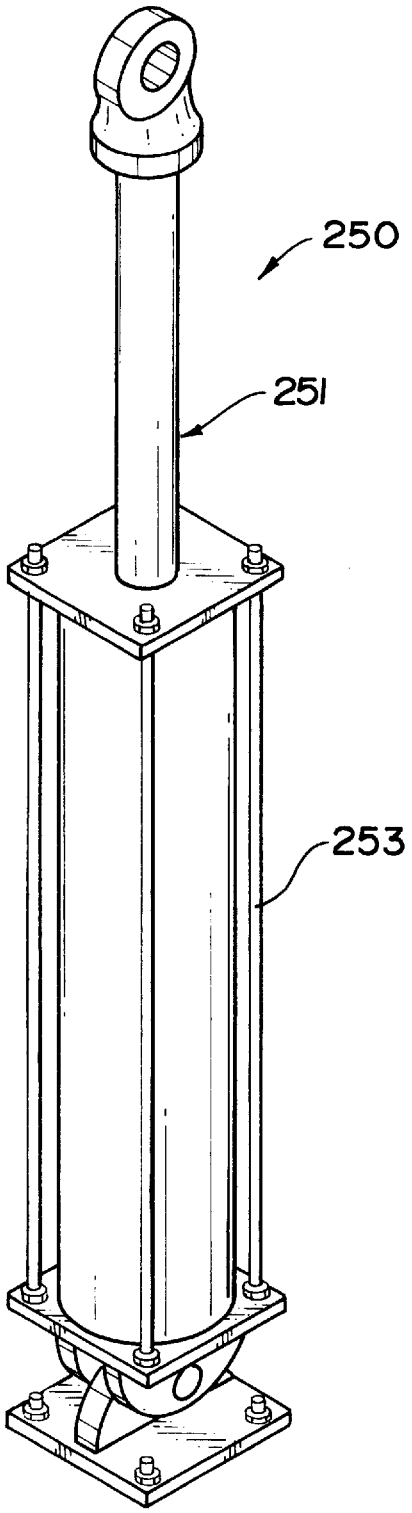
FIG. 2G is a diagram illustrating the components of a pneumatic cylinder.

The details of structure 200 and the manner in which it is erected are now discussed with reference to FIGS. 2A–2F. FIG. 2A is a diagram illustrating a preassembled structure corresponding to, for example, module 110 before erection. The pre-assembled structure is shown in a compact form suitable for shipment. FIGS. 2B and 2C illustrate in further detail bottom portion 299 and top portion 298 of structure 200 respectively. FIG. 2D illustrates the bottom portion 299 when a side of the wall is unfolded. The folded portion is not shown in FIGS. 2A and 2B. FIG. 2E illustrates structure 200 after top portion 298 is completely raised and the wall is unfolded. FIG. 2F provides a closer view of a pneumatic cylinder which is used for raising the top portion 298. FIG. 2G illustrates the details of an embodiment of a pneumatic cylinder. FIGS. 2A–2F are described in further detail below.

FIG. 2A is a diagram illustrating an example pre-assembled structure 200 in accordance with the present invention. Assembled module 110 is formed by erecting structure 200. Pre-assembled structure 200 is built using mostly common materials such as Aluminum tubings although other well-known building materials could be used such as, wood, steel, plastic, fiber-glass or the like provided the robustness requirements and weight limitations are also satisfied.

Pre-assembled structure 200 comprises top portion 298 and bottom portion 299, the details of which are described below with reference to FIGS. 2B and 2C. In its unassembled form, top portion 298 fits over and envelopes bottom portion 299 to provide a compact pre-assembled structure as shown in FIG. 2A. In one embodiment, before being erected, structure 200 has dimensions of 64" (high)× 88"(wide)×125"(long). It should be understood that these dimensions are selected so as to be within the range allowed for shipment using an aircraft such as a Boeing-737 plane. In addition, structure 200 may have an approximate weight of 9500 pounds as it is made of material such as Aluminum, which weight is well below the 10,500 pounds limit generally allowed for each cargo item on a plane. It should be understood that the invention contemplates other dimensions and weights consistent with specific requirements of transportation and post-assembly (i.e., after erection) use.

The details of top portion 298 and bottom portion 299 are now described with reference to FIGS. 2C and 2B respectively. Bottom portion 299 includes three openings 210, 220 and 230 (shown in FIG. 2B and 2D), and top portion 288 includes opening 215 (shown in FIG. 2C). The width of openings 220 and 230 is shown as B, and the width of opening 210 is shown as A. The openings are used to provide doors and walkways as explained below with reference to FIGS. 6A–D and 7A–D. Openings 210 and 215 together can be used to form an example door 149 of FIG. 1.

Bottom portion 299 also includes base 240. In one embodiment, base 240 comprises a rectangular skid made of fleet steel to provide a rugged platform which may be dragged or pushed around on ground if necessary. Base 240 may also be used to maintain modules 110, 120, 130, and 140 flush with each other. An example embodiment may use cone and socket arrangement at the edges of base 240 to ensure proper alignment of adjacent modules, and then use bolts and clamps to ensure a tight connection between the modules.

Wall 261 can comprise a folding wall that includes two portions 262 and 263 (shown in FIG. 2D) which are in a folded position before assembly. The folding wall is shown erected in FIG. 2D. Similarly, wall 264 can comprise a folding wall that includes two portions 265 and 266. The folding structures of walls 261 and 264 are not shown in FIG. 2B. By unfolding walls 261 and 264 as described below, opening 267 is formed as shown in FIG. 2D. Such unfolding is accomplished by rotating portions 263 and 266 about hinges connecting to 262 and 265 respectively. Folding walls 261 and 264 are shown as examples only and similar structures may be implemented in other walls without departing from the scope and spirit of the present invention. The unfolding step is typically performed after top portion 298 is raised (in step 320) as explained below.

The details of structure 200 as relevant to raising top portion 298 are now described. To aid in the erection of structure 200, the present invention includes a mechanism to aid in the raising of top portion 298 relative to bottom portion 299. In one embodiment, such a mechanism may comprise four pneumatic cylinders 250 located in the four comers of structure 200. The structure of an example pneumatic cylinder 250 is described with reference to FIG. 2G.

FIG. 2G is a diagram illustrating the structure of an example pneumatic cylinder 250 comprising a piston 251 and a hollow portion 253. Hollow portion 253 is typically air-tight. Piston 251 is raised by injecting air into hollow portion 253. Therefore, top portion 298 can be raised by injecting air into the four pneumatic cylinders 250 located at the four comers. Due to such a feature of raising, structure 200 may be erected with minimal manual labor.

Continuing with the explanation of raising top portion 298, FIG. 2E illustrates a partial cutaway view of top portion 299 showing a pneumatic cylinder 250 installed within the rod at each corner of the structure 200. Piston 251 of cylinder 250 may be tightly positioned in a hollow portion of vertical rod 252 of top portion 298. This embodiment is shown in FIG. 2E. In an alternative embodiment, piston 251 may be positioned outside of vertical rod 252. It is contemplated that additional pneumatic cylinders 251 be included in structure 200 and/or the position of pneumatic cylinders 251 may be varied according to the specific design requirements.

Air is distributed to hollow portion of each pneumatic cylinder 250 through small metal tubing system (not shown). A series of air pressure valves (not shown) may be used to ensure that all the four pistons 251 extend at approximately the same rate. Pneumatic cylinders 250 are well known in the art and are readily available in the market. A detailed view of pneumatic cylinder 250 in the bottom portion 299 is provided in FIG. 2F, which illustrates a portion of FIG. 2E (showing cylinder 250) in greater detail. Even though the present embodiment is described in the context of using pneumatic cylinders 250, it is contemplated that various alternative mechanisms for aiding in the erection may be used in accordance with the present invention.

The raising mechanism may be designed to raise the top portion 298 to one inch above a final height. The additional one inch allows for easier installation of the folding walls (e.g., 261) as explained below. After the installation of the walls, cylinders 250 may be lowered to a final desired height. Access to the interior is available after top portion 298 is raised. To reinforce the support of the top portion 298, sturdy panels made of well-known building materials may be placed along the vertical walls. Such panels may further offer protection from undesired air, rain etc. The panels may also be chosen to decrease the amount of noise propagated into the interior of building 100. Upon installation of such panels, erected structure 200 may look substantially as module 110 of FIG. 1 (without doors).

Once completely erected, structure 200 may have an approximate height of eight feet to enable mobility of average height persons in building 100. FIG. 2E illustrates structure 200 after being completely raised. In contrast to FIG. 2A, top portion 298 of FIG. 2E does not envelope or cover bottom portion 299 after being erected. It is further noted that the structure as shipped has a height of only 64 inches, which makes the unassembled structure suitable for transportation in airplanes. In addition, the installation of module 110 requires minimal number of tools.

The structure and installation of walkways and doors in the openings of structure 200 are now explained. As already noted, openings 210 and 215 may be used for providing a door 149 (illustrated with reference to FIGS. 4A–G), and openings 220, 230 may be used for providing doorways and passageways into adjacent assembled modules 140 and 120 of FIG. 1 respectively (illustrated with reference to FIGS. 5A–D, 6A–D, 7, and 8A–B). Even though bottom module 299 of FIGS. 2A–G is shown with openings 210, 220, and 230 and without structure for doors and walkways, an embodiment of the present invention preferably includes such structures for doorways and walkways in the openings even during shipment. The structures are designed so that they may be placed in the corresponding openings. Installing the structures in the openings prior to shipment enables the present invention to cut down on the time to erect the building 100 in the disaster stricken site. However, the structures for doorways and walkways can be alternatively packaged separately during transportation and installed with structure 200 during assembly.

The structure and installation of door 149 is now explained with reference to FIGS. 4A–G. Door 149 is a structure preferably having top half door assembly 450 and bottom half door assembly 400 described in further detail in FIGS. 4A and 4B respectively. FIGS. 4C, 4D, and 4E illustrate the half door assemblies 400, 450 in a shipping position, an intermediate position while being raised, and a final position after being completely raised respectively. FIG. 4F illustrates door 149 after assembly. FIG. 4G illustrates the dimensions of door 149 and the components. FIGS. 4A–4G are now explained in detail.

Figure 4A:
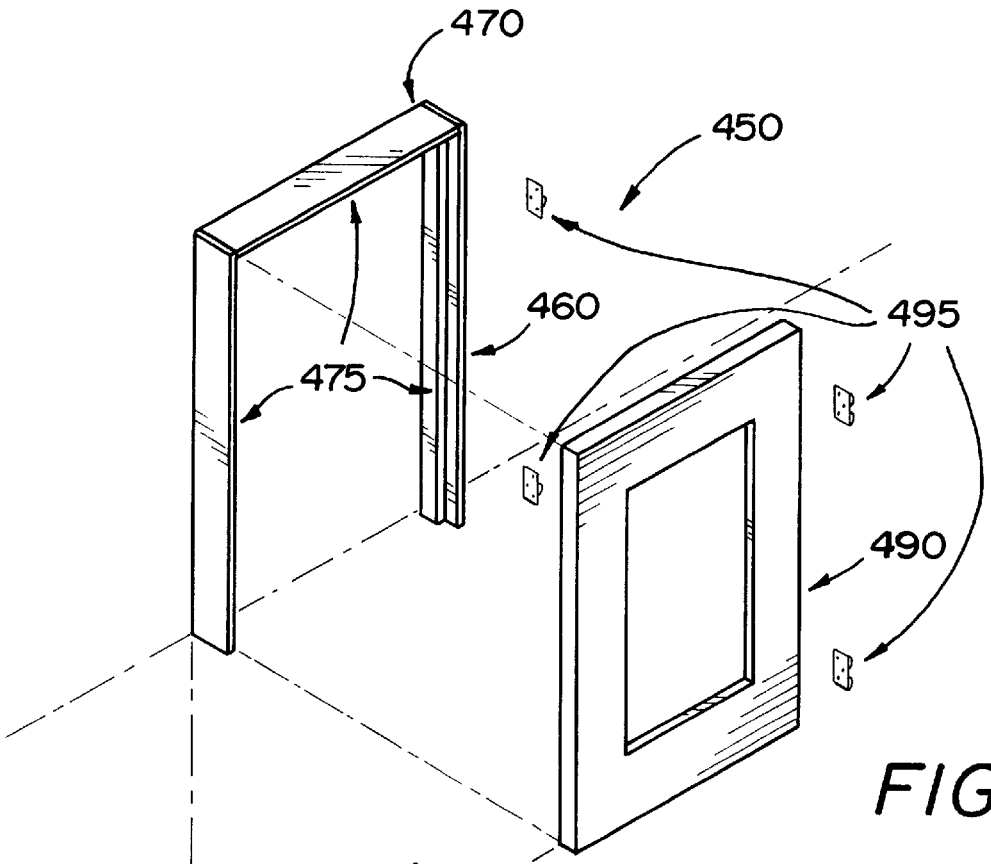
FIGS. 4A and 4B illustrate the components of two half door assemblies which when assembled form a door for the front of module.

FIG. 4A illustrates the components of top half door assembly 450. Top half door assembly 450 comprises door portion 490, door jamb 475, hinges 495, and frame 470. Frame 470 is firmly attached to walls surrounding openings 215 and 210 respectively. Hinges 495 connect door portion 490 and allow door portion 490 to be rotated. Such rotation allows door portion 490 to be opened and closed. Door jamb 475 restricts the movement of door portions 490 and 430 in the inward direction (i.e., into the module 110).

Figure 4B:
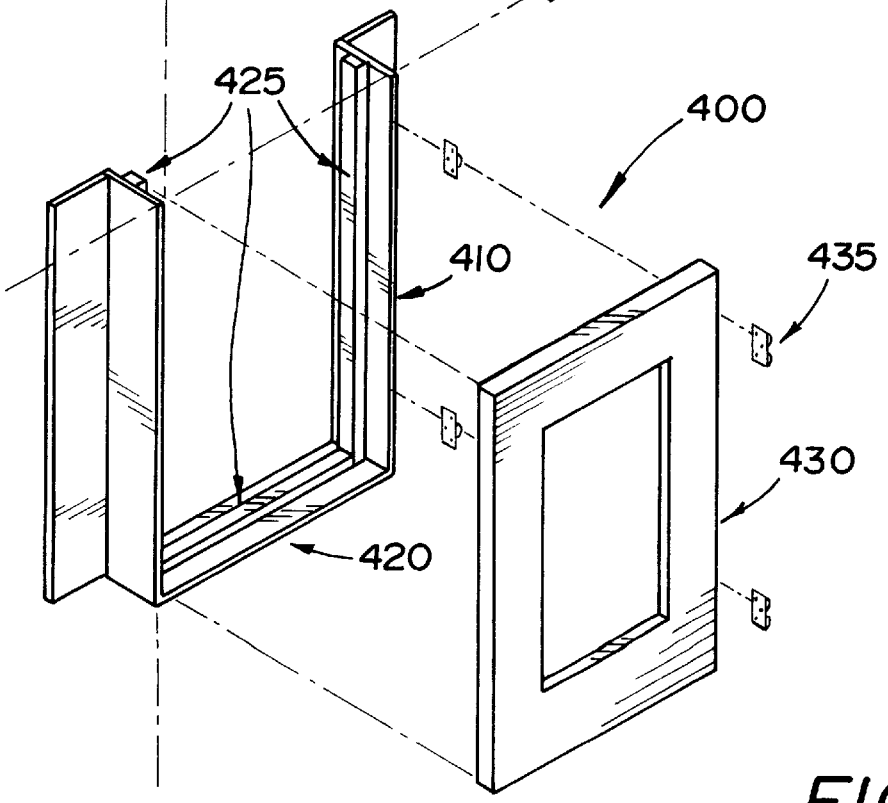
Figure 4E:
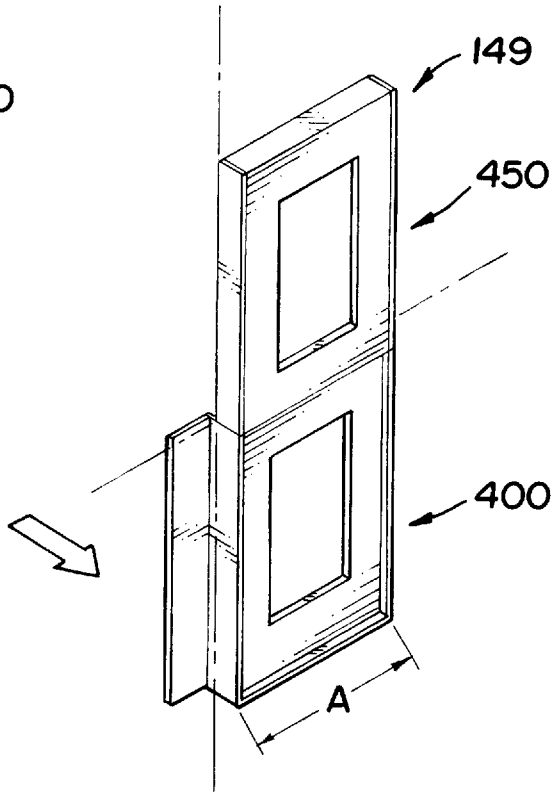
FIG. 4E is a diagram illustrating a position in which the bottom door assembly is moved forward to form a door for use in a module.
Figure 4D:
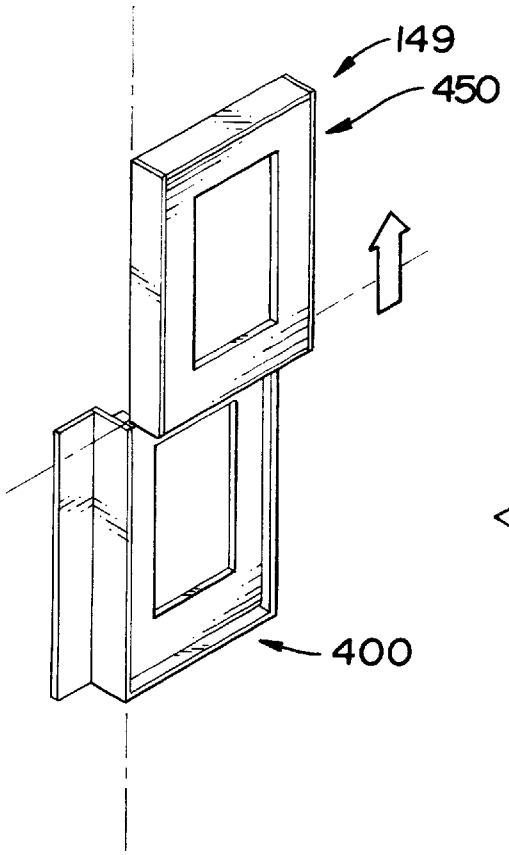
FIG. 4D is a diagram illustrating a position in which top half door assembly is raised relative to the bottom half door assembly.
Figure 4C:
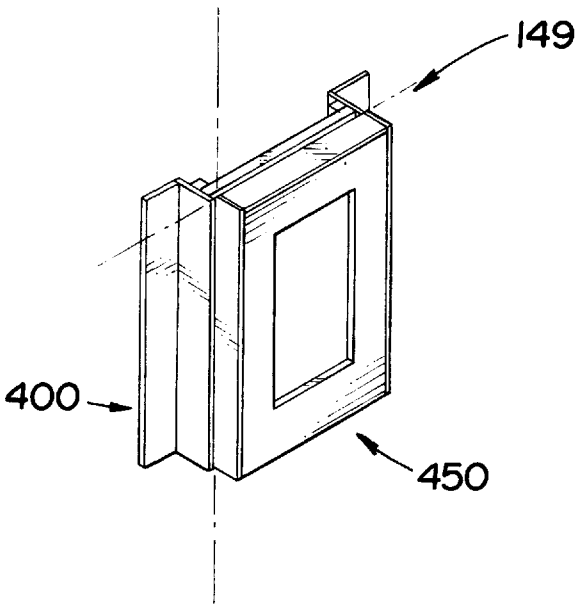
FIG. 4C is a diagram illustrating two half door assemblies during shipment.
Figure 4F:
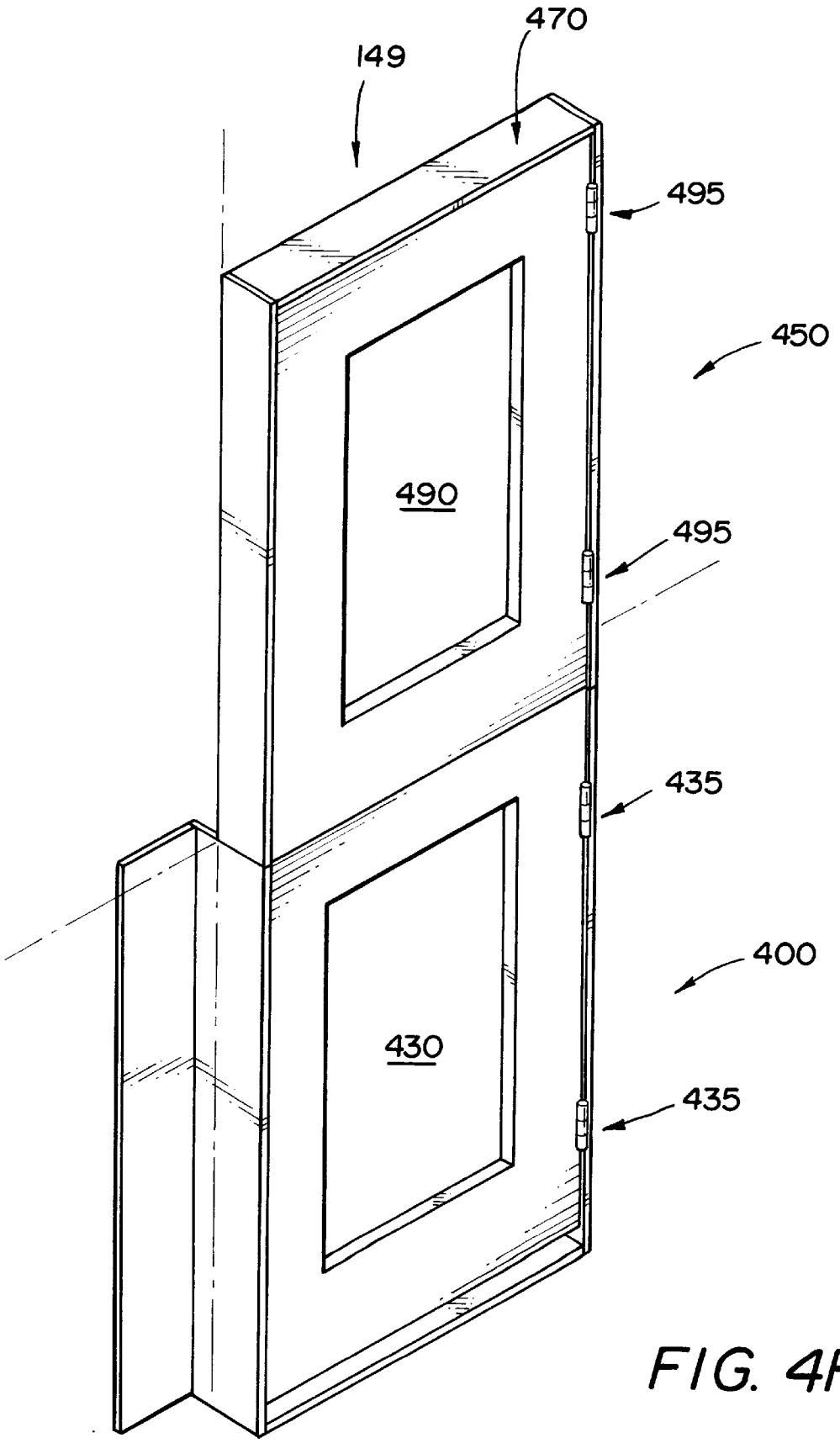
FIG. 4F is a diagram illustrating a detailed view of the door.
Figure 4G:
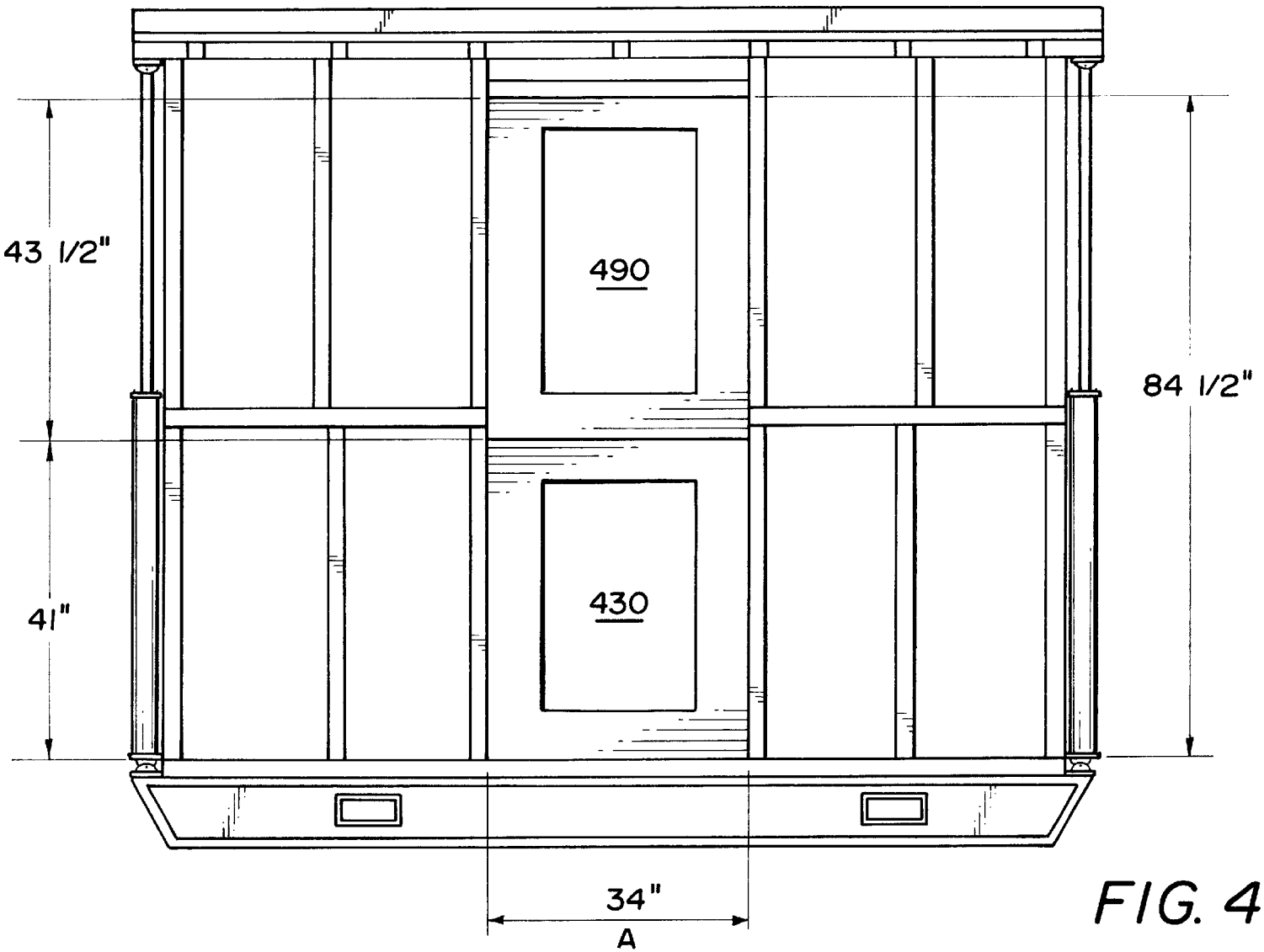
FIG. 4G is a diagram illustrating the front view of the door with corresponding dimensions.

Similarly, bottom half door assembly 400 illustrated in FIG. 4B comprises door portion 430, door jamb 425, frame 420, and hinges 435. The function of each of these components is similar to the corresponding components of half door assembly 450, and the explanation is not repeated for conciseness.

FIG. 4C illustrates the position of half door assemblies 400 and 450 during shipment. Half door assemblies 400 and 450 are shown located side-by-side. As already noted, half door assemblies 400 and 450 may be located in opening 210 during shipment. As the assemblies are located side-by-side, structure 200 may take a compact position. The compact position is illustrated in FIG. 2A although assemblies 400, 450 are not shown in FIG. 2A. As further noted already, half door assemblies 400 and 450 may be shipped separate from structure 200 and then assembled with structure 200.

FIG. 4D illustrates a position of door 149 in which top half door assembly 450 is raised vertically. As frame 470 is firmly attached to the walls of top portion 298, half door assembly 450 can be raised along with top portion 298 in step 320. After top half door assembly 450 is raised, bottom half door assembly 400 is pushed forward such that the bottom surface of the door portion 490 in top half door assembly 450 is flush with top surface of the door portion 430 of bottom half door 400 as illustrated in FIG. 4E. In such a position, the door portions 430 and 490 together insulate inner side of module 110 from external air and rain etc.

FIG. 4F is a detailed view of door 149 after assembly. Door portion 490 rotates about hinges 495 into an open position (not shown). The door can be closed again using hinges 495. Similarly, door portion 430 also rotates about hinges 435. FIG. 4G illustrates the dimensions of door 149 in one embodiment of the present invention. Top door portion 490 is 43.5" long and 34" wide. Bottom door portion 430 has dimensions of 41" long and 34" wide.

The structure and installation of folding wall 500 is now explained with reference to FIGS. 5A–D. Folding wall 500 is preferably attached, for example, in opening 230 of FIG. 2B prior to shipment so as to minimize the time to install building 100. In the alternative, folding wall 500 may be placed later in opening 230 as already noted. Folding wall 500 includes two half walls 520 and 530 connected by hinges 523. Hinges 523 allow the half walls 520 and 530 to be folded in a stowed position as shown in FIG. 5A.

Figure 5B:
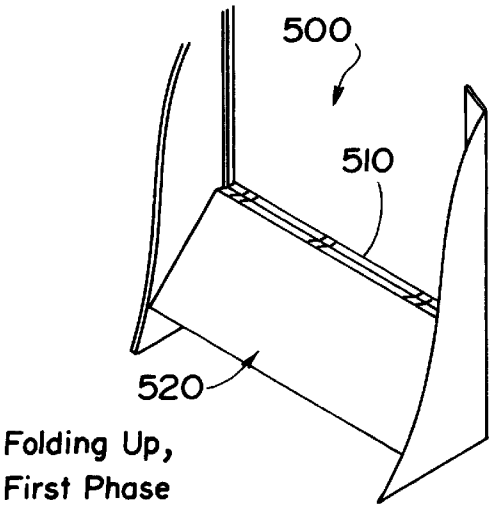
FIGS. 5A–D are diagrams illustrating the structure and operation of an example folding wall in accordance with the present invention.
Figure 5D:
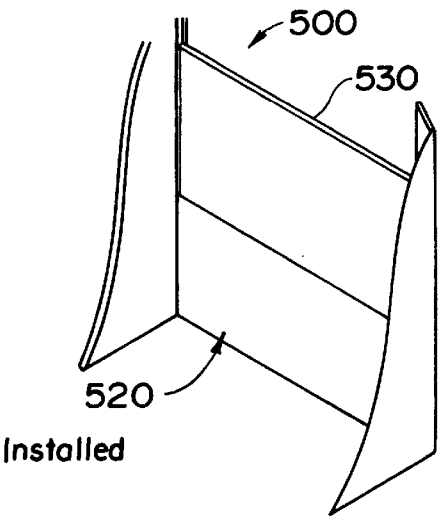
Figure 5A:
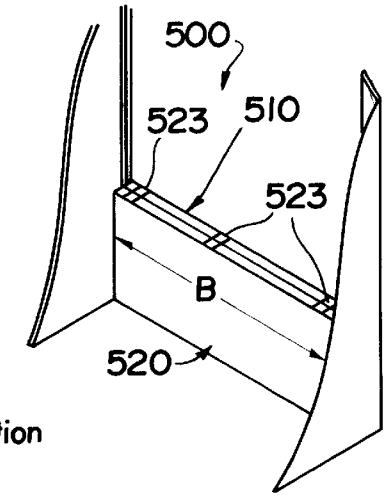
Figure 5C:
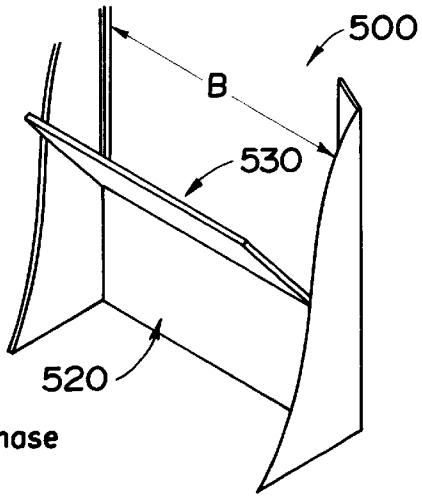
Figure 6A:
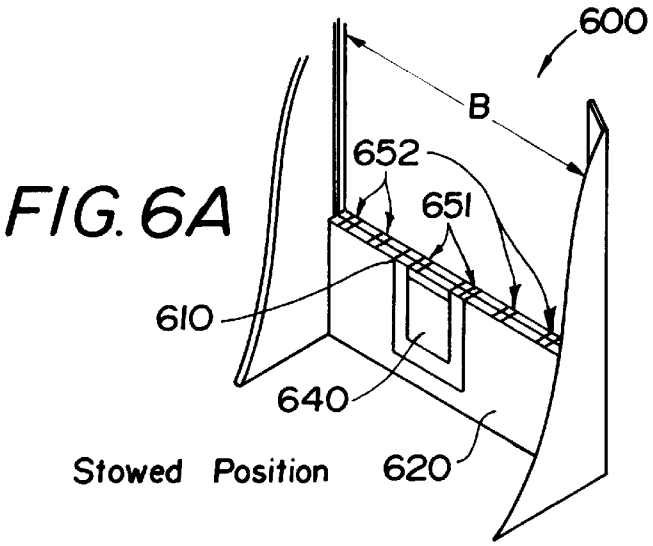
FIGS. 6A–D are diagrams illustrating the structure and operation of an example folding wall including an example folding door.
Figure 6B:
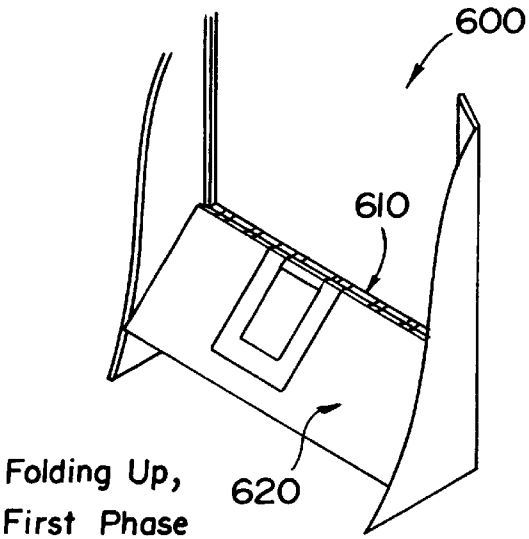
Figure 6C:
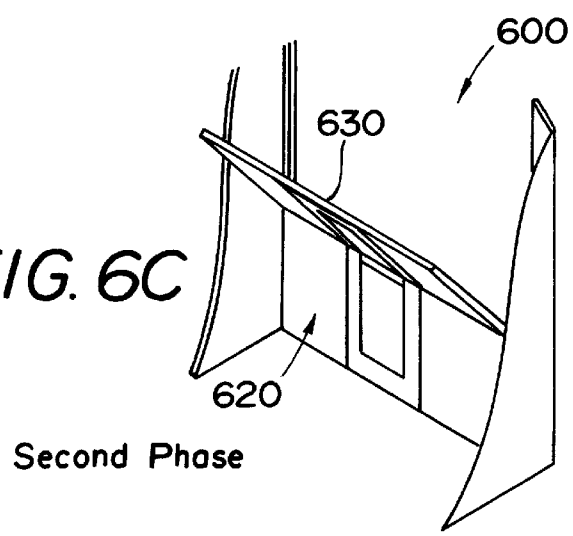
Figure 6D:
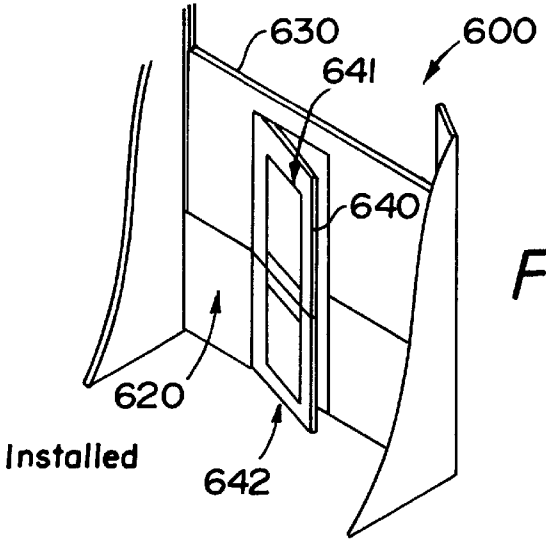

While constructing module 110 at the disaster area, half wall 520 is slowly raised about the hinges 523 as illustrated in FIGS. 5B–5D. In one embodiment, half wall 520 is light enough so that one or two people may lift half wall 520. Half wall 520 may be lifted (by rotating as shown in FIGS. 5B–D) while the top portion 298 is raised to more than an inch above the final position as already explained. The additional inch allows half wall 530 to be completely raised without obstruction from top portion 298. Once wall 500 is completely unfolded as shown in FIG. 5, top portion 298 may be lowered back by an inch to the final position as already explained.

Due to the folding of the wall while shipment, structure 200 may be in a compact position. By pre-attaching wall 500 to the lower portion of an opening in lower portion 299, the installation time for module 200 may be minimized.

The structure and installation of a folding wall 600 with door formed therein is now illustrated with reference to FIGS. 6A–6D. Folding wall 600 differs from folding wall 500 in that door 640 is formed in folding wall 600. Accordingly, folding wall 600 is used where the wall needs to have a door. Either of the walls 500, 600 may be installed in opening 267 shown in FIG. 2D.

Door 640 of wall 600 includes two door-halves 641 and 642, which are symmetrical in one embodiment. Door-halves 641 and 642 fold about hinges 651. Hinges 651 are preferably coaxially aligned in the same horizontal line as hinges 652 provided between the two halves of wall 600. Wall 600 of FIGS. 6A–D is installed similar to wall 500 as already explained. In the interest of conciseness, the explanation is not repeated again. As the upper half of wall 600 is raised, door-half 641 is also raised with the wall as illustrated in FIGS. 6A–6D.

Figure 7:
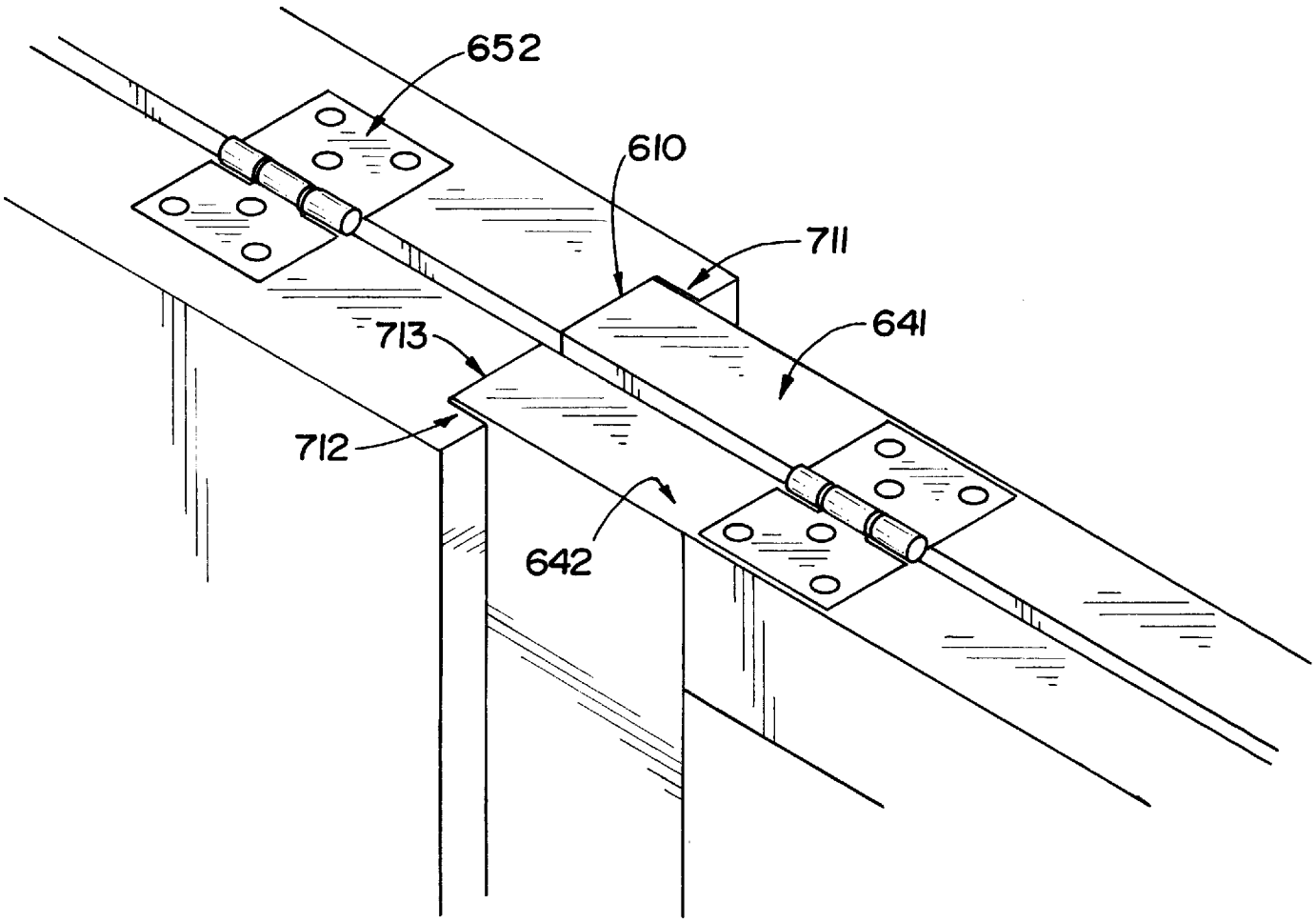
FIG. 7 is a diagram illustrating an example door jamb used to hold the folding doors in proper place during the transportation of an example structure.

Wall 600 includes a door jamb 610 which holds door-halves 641 and 642 in a fixed position when wall 600 is in a stowed position. FIG. 7 illustrates further details of this feature of door jamb 610. Doorjamb 610 is shown with two small edges 711 and 712 defining channel 713 therebetween. When wall 600 is in a stowed position (i.e., with the wall-halves folded), door halves 641 and 642 are held tightly in channel 713. As the door halves 641 and 642, and wall 600 form one rigid unit during shipment/transportation, the combination contributes to the structural integrity of the shipping container. When wall 600 is in an unfolded position, edges 711 and 712 limit the outward movement of the respective door halves 641 and 642.

Figure 8:
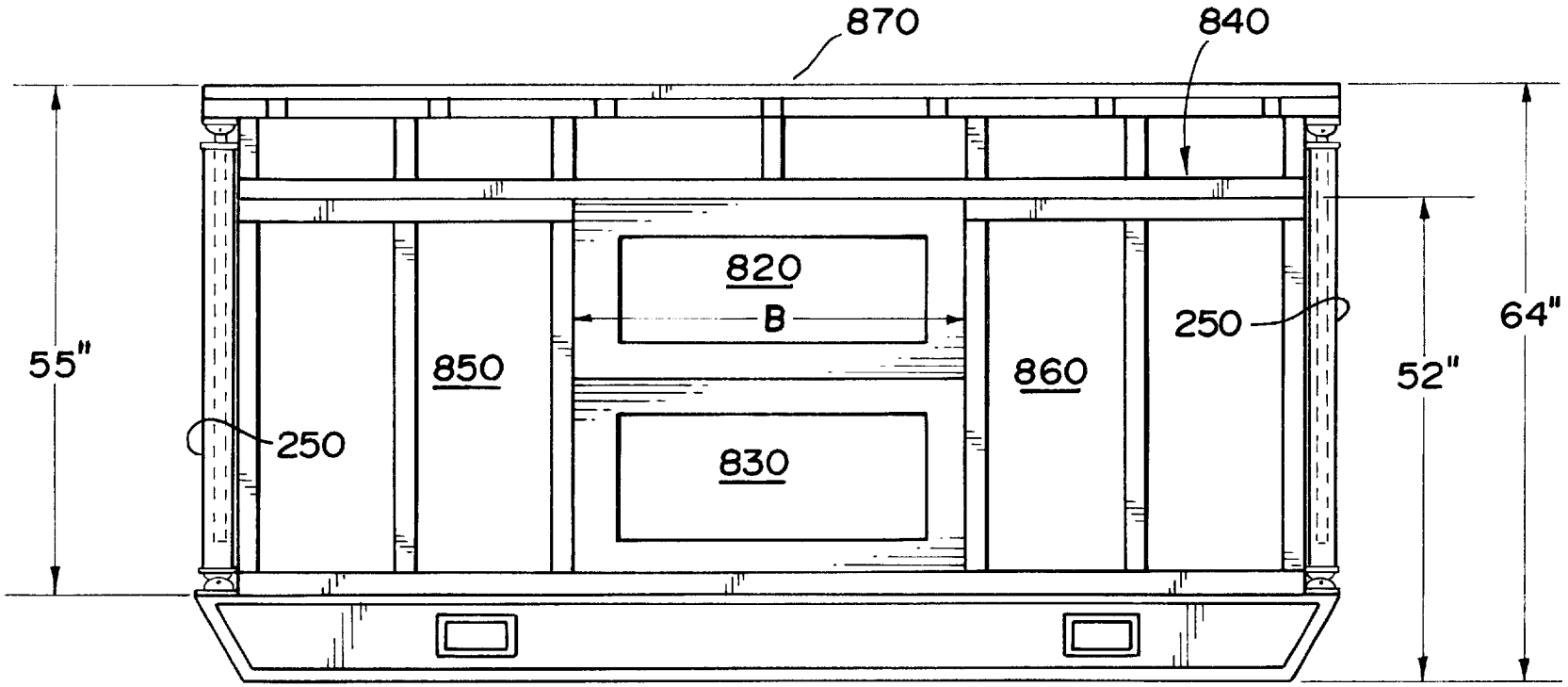
FIG. 8 is the diagram of a front view of a wall which includes the structure for a walkway in one embodiment of the present invention.
Figure 8B:
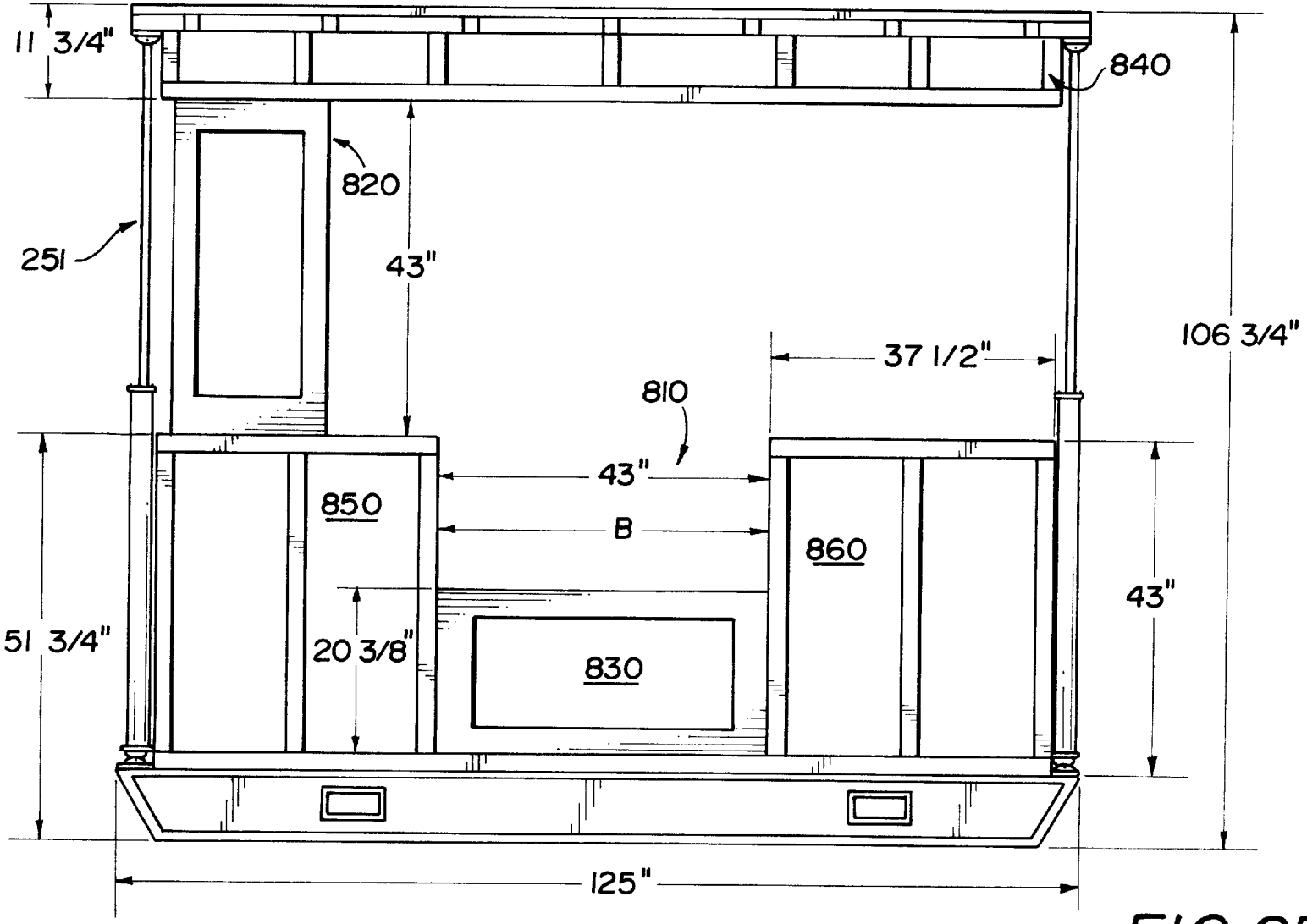
FIG. 8B is a diagram illustrating the structure of the walkway after completion of installation.

Continuing with the explanation of the structure and installation of passageways and doors in/between the modules, FIGS. 8A and 8B are drawings illustrating the provision of a walkway in one embodiment of the present invention. FIG. 8A is a diagram illustrating the view of a side corresponding to a walkway when structure 200 is in the unassembled position. FIG. 8B is a diagram illustrating the view of the same side as the walkway is being formed.

Structure 200 can be provided with panels 820 and 830 during shipment. Panels 820 and 830 are bolted to walls 850 and 860 at opposite ends as shown. Rail 840 is attached firmly to top portion 298 (side view shown as 870). When top portion 298 is raised in step 320, rail 840 is also raised. As illustrated in FIG. 8B, top portion may be raised approximately 43" in one embodiment. Panels 820 and 830 are also designed to be approximately 43" long so that the panels snugly fit into the space between the top of module 298 and the walls 850, 860.

In FIG. 8B, only panel 820 is shown in the final installed position. Ultimately, panel 830 is also moved to between wall 860 and rail 840. Once panels 830 and 820 are moved to final positions, the opening 810 serves as a walkway in the assembled module 110. Opening 810 can correspond to openings 220 or 230 of FIG. 2C. Rail 840 provides robustness to assembled module 110.

Thus, walls (with and without doors) and walkways may be provided in modules 110, 120, 130, and 140 as explained above. Using a combination of the walls and walkways described above, a variety of module configurations can be assembled.

Such modules are joined together to provide building 100. The side walls (e.g., 114, 141, 112, and 121 of FIG. 1) where the modules are mated must be flush to provide a smooth weather tight surface and to provide a smooth interior floor. As already noted, base 240 is also designed to maintain adjacent bases (and thus adjacent modules) flush. In addition, the roof of the modules is slanted down from the mating wall (e.g., 112, 114) to the exterior wall (e.g., 111, 113 of FIG. 1) so as to provide for rain (melted snow) runoff.

Once the modules are assembled, each module may be further modified according to the specific requirements of the situation. For example, some modules may be used as office rooms, some rooms may be used to install telecommunication equipment. An antenna may be placed at the comer of a module, where there is more structural support for the roof.

Thus, while various embodiments of the present invention have been described above, it should be understood that they have been presented by way of example only, and not limitation. Thus, the breadth and scope of the present invention should not be limited by any of the above described example embodiments, but should be defined only in accordance with the following claims and their equivalents.

What is claimed is:

1. A structure, comprising:

a first portion and a second portion, wherein the second portion fits over the first portion in a first position to form a compact package suitable for transportation, and wherein the second portion is raised relative to the first portion in a second position, wherein the structure in the second position forms a module having sufficient height to provide adequate headroom for an average height person such that the resulting module is adapted for use as a shelter by the person; wherein the first portion comprises an opening for the installation of a walkway.

2. The structure of claim 1, wherein the structure in the first position has dimensions suitable for shipment in an airplane.

3. The structure of claim 1, further comprising a mechanism for raising the second portion.

4. The structure of claim 3, wherein the mechanism for raising comprises one or more pneumatic cylinders.

5. A structure, comprising:

a first portion; and a second portion, wherein the second portion fits over the first portion in a first position to form a compact package suitable for transportation, and wherein the second portion is raised relative to the first portion in a second position, wherein the structure in the second position forms a module having sufficient height to provide adequate headroom for an average height person;

wherein the first portion comprises an opening which accommodates the installation of a folding wall, wherein the folding wall is in a folding position when the structure is in the first position, and wherein the folding wall is in an open position when the structure is in the second position.

6. The structure of claim 5, wherein the folding wall further comprises a folding door.

7. The structure of claim 6, wherein the folding wall is designed to fold about a first set of hinges, and the folding door is designed to fold about a second set of hinges, wherein the first set of hinges and the second set of hinges are aligned coaxially along a line.

8. The structure of claim 6, wherein the wall comprises two edges defining a channel at a door jamb, wherein the portions of the folding door are located within the channel when the structure is in the first position, and wherein the edges limit the outward movement of the folding door when the structure is in the second position.

9. The structure of claim 5, wherein the first portion comprises an opening for the installation of a walkway having a width of approximately the height the second portion is raised relative to the first portion.

10. The structure of claim 9, farther comprising a set of panels approximately equal to the width of the walkway, wherein the panels are provided in the opening when the structure is in the first position, and wherein the panels are provided in an area between the first portion and the second portion when the structure is in the second position.

11. The structure of claim 5, wherein the structure comprises a first half door assembly and a second half door assembly, wherein the two assemblies are adjacent to each other in the first position of the structure, and wherein the second half door assembly is raised vertically relative to the first half door assembly in the second position of the structure, and wherein each of the assemblies comprises a half door, the two half doors together forming a door for the module.

12. The structure of claim 11, wherein the first half door assembly is designed to be moved forward after the second half door assembly is raised.

13. The structure of claim 5, wherein the structure in the first position has dimensions suitable for shipment in an airplane.

14. The structure of claim 5, further comprising a mechanism for raising the second portion.

15. The structure of claim 14, wherein the mechanism for raising comprises one or more pneumatic cylinders.

16. A structure comprising:

a first portion and a second portion, wherein the second portion fits over the first portion in a first position to form a compact structure, and wherein the second portion is raised relative to the first portion in a second position, wherein the structure in the second position forms a module having sufficient height to provide adequate headroom for an average height person, and wherein the structure in the first position has dimensions suitable for shipment in an airplane;

a mechanism for raising the second portion, the mechanism comprising one or more pneumatic cylinders;

three openings comprising a first opening, a second opening, and a third opening, the three openings being positioned in the first portion;

a folding wall located in the first opening, wherein the wall is in a folding position when the structure is in the first position, and wherein the wall is in an open position when the structure is in the second position;

a second folding wall located in the second opening, the second folding wall comprising a folding door, wherein the second folding wall is designed to fold about a first set of hinges, and the folding door is designed to fold about a second set of hinges, wherein the first set of hinges and the second set of hinges are aligned coaxially along a line;

a door jamb comprised in the second folding wall, the door jamb including two edges defining a channel, wherein the portions of the folding door are located within the channel when the structure is in the first position, and wherein the edges limit the outward movement of the second folding door when the structure is in the second position;

a walkway defined by the third opening, the walkway having a width equal to approximately the height the second portion is raised relative to the first portion; and a set of panels approximately equal the width of the walkway, wherein the panels are provided in the third opening when the structure is in the first position, and wherein the panels are provided in an area between the first portion and the second portion when the structure is in the second position.

17. A method of providing a module for use in a disaster stricken site, the method comprising the steps of:

providing a compact structure comprising a first portion and a second portion, wherein the second portion fits over the first portion;

transporting the compact structure to the site;

raising the second portion relative to the first portion such that the space between the first portion and the second portion is sufficient to provide adequate headroom for an average height person; and installing walls and walkways in the raised structure.

18. The method of claim 17, wherein the step of providing a compact structure further comprises the step of providing folding walls in the compact structure, and wherein the step of installing further comprises the step of unfolding the folding walls.

19. The method of claim 17, wherein the step of transporting further comprising the step of transporting the compact structure in an airplane.

* * * * *